US007708216B2

(12) United States Patent
Yang et al.

(10) Patent No.: US 7,708,216 B2
(45) Date of Patent: May 4, 2010

(54) HIGH TURBULENCE MILL AND BI-NEGATIVE PRESSURE TURBINE THEREOF

(76) Inventors: Fumao Yang, c/o No. 123, Door 4, No. 282, Dunhuang Road, Qilihe District, Lanzhou City, Gansu Province, 730050 (CN); Xingfa Liu, c/o No. 123, Door 4, No. 282, Dunhuang Road, Qilihe District, Lanzhou City, Gansu Province, 730050 (CN)

( * ) Notice: Subject to any disclaimer, the term of this patent is extended or adjusted under 35 U.S.C. 154(b) by 806 days.

(21) Appl. No.: 10/599,216

(22) PCT Filed: Jan. 24, 2005

(86) PCT No.: PCT/CN2005/000104

§ 371 (c)(1),
(2), (4) Date: Oct. 24, 2006

(87) PCT Pub. No.: WO2005/089948

PCT Pub. Date: Sep. 29, 2005

(65) Prior Publication Data

US 2008/0245914 A1 Oct. 9, 2008

(30) Foreign Application Priority Data

Mar. 23, 2004 (CN) ..... 2004 1 0039858

(51) Int. Cl.
*B02C 19/00* (2006.01)

(52) U.S. Cl. ..... 241/55; 241/188.1; 241/189.1

(58) Field of Classification Search ..... 241/57, 241/55, 39, 275, 188.1, 189.1; 415/98; 416/200 R, 416/200 A See application file for complete search history.

(56) References Cited

U.S. PATENT DOCUMENTS

| | | | | |
|---|---|---|---|---|
| 3,978,978 | A * | 9/1976 | Herter | 198/601 |
| 5,732,894 | A * | 3/1998 | Sheahan | 241/56 |
| 6,065,697 | A * | 5/2000 | Engel et al. | 241/56 |
| 2003/0098374 | A1 * | 5/2003 | Kang | 241/56 |

* cited by examiner

*Primary Examiner*—Dana Ross
*Assistant Examiner*—Matthew G Katcoff
(74) *Attorney, Agent, or Firm*—Schmeiser, Olsen & Watts

(57) ABSTRACT

A high turbulence mill used for producing supermicro powder and nanomaterials includes: a driving device provided on a base; a hollow grinding casing having a toothed ring-shaped guide stator fixed to an inner circumference thereof; a bi-negative pressure turbine rotatably mounted within the grinding casing; a hopper for delivering materials into the grinding casing via a material feeding pipe; a material discharging pipe communicated with the grinding casing for discharging pulverized products; and a control device for electrically controlling the high turbulence mill. When the specifically designed bi-negative pressure turbine spins at a high speed within the grinding casing under the driving operation of the motor, strong vortexes and high turbulence will be formed in the grinding casing, and thus a gas-solid two-phase flow is formed. Under the high turbulence, the materials are subjected to violent self-grinding effect, strong impact and strong shear force, and then an accelerated and effective pulverization of the materials is obtained.

13 Claims, 4 Drawing Sheets

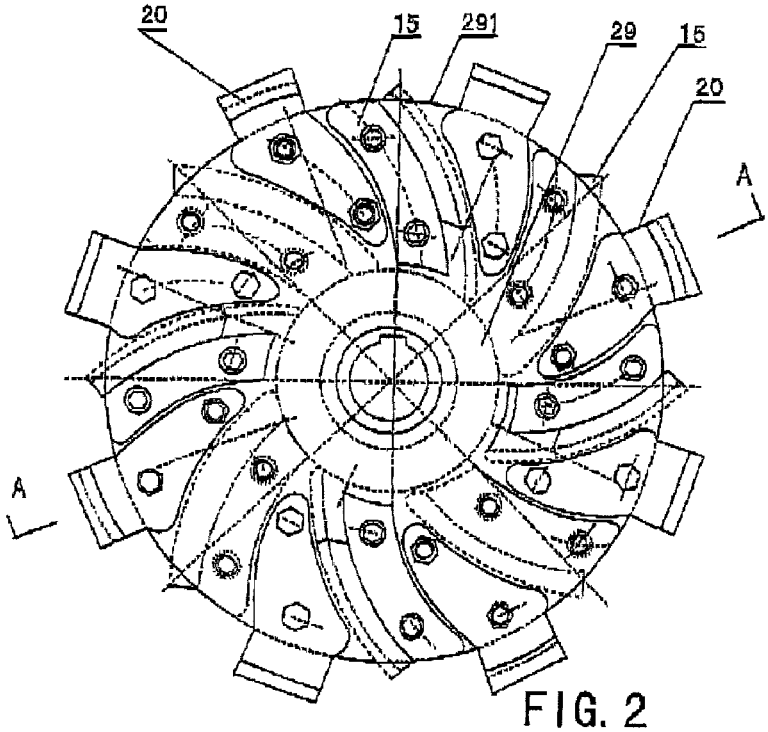
FIG. 2
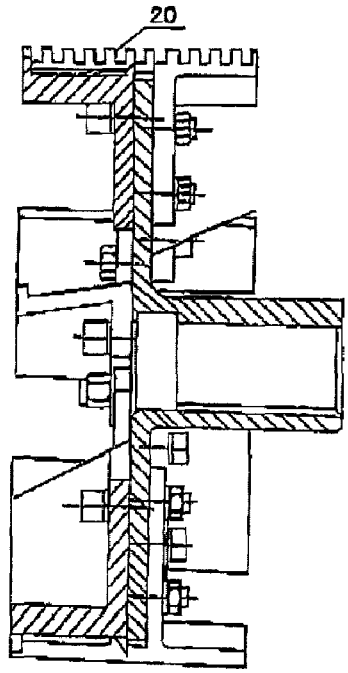
FIG. 3
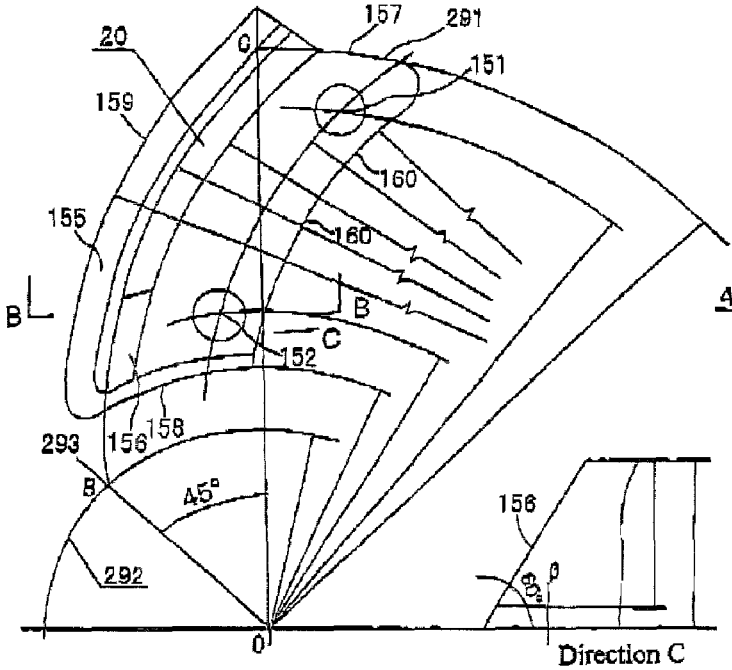
FIG. 4
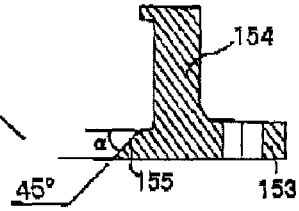
FIG. 5
FIG. 6

HIGH TURBULENCE MILL AND BI-NEGATIVE PRESSURE TURBINE THEREOF

FIELD OF THE INVENTION

The present invention relates to a device for producing supermicro powder and nanomaterials, and more particularly, to a high turbulence mill for grinding materials into supermicro powder and a bi-negative pressure turbine adapted for the high turbulence mill. The fields into which the high turbulence mill could be applied not only include high-tech fields such as military, aerospace industries, but also include many other fields such as microelectronics, new drugs, new material, new energy, as well as general chemical, mechanical, metallurgy, environmental protection, food and daily-use products industries.

BACKGROUND OF THE INVENTION

For domestic and overseas science and technology domain, the technique for producing super find powder could be deemed as a "trans-century" high-tech.

Rapid development in science and technology endows supermicro materials and nanomaterials with wide application prospects, and also the research regarding supermicro materials and nanomaterials is very important for promoting the progress of related industries. In general, powders with a granularity of 1 micrometer level or less are referred as supermicro materials, and powders with a granularity of 0.1 micrometer level or less are referred as nanomaterials.

Till now, there has been no report regarding the technology of producing supermicro material (sub-micrometer scale). It is said that supermicro materials are of a bottle-neck material from superfine materials to nanomaterials, but there seems to have no suitable technology or equipments for producing such materials.

Equipments for producing superfine materials include mechanical impact pulverizer, air jet pulverizer and vibrational grinder etc. An upper limit of the granularity which could achieved by these equipments can only reach about 5 micrometer. There have been many reports about the technology for producing nanomaterials, which mainly utilizes chemical methods, such as solid-phase method, liquid-phase method, gas-phase method and plasma method, laser method etc. Some investigations claim that nanomaterials produced by chemical methods usually have changes in physical property thereof, and thus can not exhibit a desired effect when in use. Moreover, it is difficult to solve the problem of conglomeration of such materials. Therefore, the production efficiency is low and the production cost is high, which leads that nanomaterials can only be produced in a small amount in laboratories and cannot be made in industry.

Supermicro (sub-micrometer scale and nano scale) material could be deemed as a basic material in 21st century, and also is one of the most popular fields in the high-tech world. Whether the supermicro and nanomaterials could be produced by means of physical preparation technologies is a trans-century hot research topic that has raised worldwide attention from science and technology field. Many governments, especially those of developed countries, have devoted huge amount of money in the research and development of such technologies.

SUMMARY OF THE INVENTION

In view of the current situation as well as the technical problems existing in the research and development of supermicro powder materials and nanomaterials and their application, an object of the present invention is to provide a pulverizing or grinding device which is better than conventional pulverizing or grinding equipments, and is able to produce supermicro powder and nano powder with a high efficiency.

In order to achieve the above-mentioned object, the present invention provides a bi-negative pressure turbine for a high turbulence mill, which comprises a base plate and a plurality of blades provided at both sides of the base plate and having the same spiral orientation, wherein the blades at either side of the base plate are uniformly arranged in a circumference direction of the base plate, and the blades at one side of the base plate alternate with those at opposite side of the base plate in the circumference direction of the base plate.

In the bi-negative pressure turbine as described above, each blade having a curved profile with an L-shaped cross section, is composed of a base and a rib portion extending from the base in a direction perpendicular to the base, with two screw holes perforated at an inner side portion of the base through which bolts are inserted to fix the blade onto the base plate.

In the bi-negative pressure turbine as described above, the base of the blade is formed with a first inclined surface at an outer side end thereof, and an angle $\alpha$ formed between the first inclined surface and a plane of the base plate is in a range of 30°-60°.

In the bi-negative pressure turbine as described above, the blade is further formed with a second inclined surface at a side end thereof closer to a centre of the base plate, and an angle $\beta$ formed between the second inclined surface and the plane of base plate is in a range of 45°-70°.

In the bi-negative pressure turbine as described above, the curved profiles of the blades are formed in such a manner that radial outer edges of bases of the blades coincide with a base circle of the base plate, radial inner edges of the blades are positioned on a circle concentric with the base circle, and a transverse inner edge and a transverse outer edge of each blade are two arcs with the same circle centre.

In the bi-negative pressure turbine as described above, the same circle centre of the transverse inner edge and the transverse outer edge of the blade is a point at which a first arc and a second arc intersect; wherein the first arc has a radius as long as a radius of the base plate; and takes a first intersection point at which the base circle of the base plate and a first line passing through the centre of the base plate intersect, as its circle centre; and wherein the second arc has a radius as long as the radius of the base plate; and takes a second intersection point at which an arc taking the centre of the base plate as its centre and having a radius 0.25-0.35 times as long as the radius of the base plate and a second line passing through the centre of the base plate and having a degree of 45° formed with the first line intersect, as its circle centre.

The bi-negative pressure turbine as described above, further comprises a plurality of toothed impact plates arranged in pairs between two adjacent blades at both sides of the base plate.

In the bi-negative pressure turbine as described above, the toothed impact plate comprises: a mounting portion formed with two mounting holes through which bolts are inserted to fix the toothed impact plate onto the base plate; and an operating portion located above the mounting portion, which is integrated with the mounting portion via a swallow-tailed slot thereof and is formed on its top with rectangular teeth extending in a circumference direction of the base plate.

The present invention also provides a high turbulence mill having the above-mentioned bi-negative pressure turbine, for producing supermicro powder, wherein the high turbulence mill comprises a driving device provided on a base and comprising a motor and a driving shaft coupled with the motor; a hollow grinding casing arranged above the base and having a toothed ring-shaped guide stator fixed to an inner circumference thereof; a bi-negative pressure turbine rotatably mounted within the grinding casing and driven by the driving device; a hopper for delivering materials into the grinding casing via a material feeding pipe; a material discharging pipe communicated with the grinding casing, for discharging pulverized products; and a control device for electrically controlling the high turbulence mill. When said bi-negative pressure turbine spins at a high speed inside the grinding casing under the driving operation of the electric motor, it will stir vortexes and turbulence in air and materials within the grinding casing so that a gas-solid two-phase flow is formed. Furthermore, the materials are subjected to effects of the toothed ring-shaped guide stator and the high turbulence field. Thus, violent self-grinding effect, impact and strong shear force are generated among fine particles or the powders, and then an accelerated and effective pulverization of the materials is obtained.

In the high turbulence mill as described above, the grinding casing is water-cooled and is divided into an inner chamber and an outer chamber, and the outer chamber is communicated with a circulating water tank.

The high turbulence mill further includes a spiral conveyer driven by a speed-adjustable electric motor, both ends of the spiral conveyer respectively connected with the hopper and the material feeding pipe, for delivering materials into the grinding casing.

In the high turbulence mill as described above, an end of the material discharging pipe is connected with a spherical connector, a cyclone collector, a cloth-bag collector, and an inducing fan in series, for collecting the finalized products.

In the high turbulence mill as described above, the grinding casing is provided with an inner flange plate and an outer flange plate at each of left and right sides thereof; a mounting hole is formed at a center portion of one inner flange plate at one side, and the driving shaft of the driving device goes through the mounting hole and is fixed to the bi-negative pressure turbine located within the grinding casing by a bolt; a material inlet is formed on a region of said one inner flange plate over the mounting hole, and the material feeding pipe is connected to the material inlet; and a material outlet is formed at a center portion of the inner flange plate at the opposite side, and the material discharge pipe is connected to the material outlet.

In the high turbulence mill as described above, the toothed ring-shaped guide stator has 50 or more serrate teeth, each of which has a tooth angle between 40°-50°.

The high turbulence mill according to the present invention utilizes a high turbulence, which is generated as a result of a high speed rotation of the specifically designed bi-negative pressure and dual vortex turbine, to pulverize or grind materials. A high turbulence is occurred when Renault number $Re>1.5\times10^5$. The Renault number of the turbulence mill of the present invention has ° reached a level of $Re>6.6\times10^5$, by which the generation of a high turbulence is assured.

An important characteristic of turbulence is irregularity, i.e. an irregular and random movement composed of different sized vortexes. It essential characteristic is random pulses. Its speed field and pressure field are random not only in respect to time domain but also in respect to space domain. Another crucial characteristic of turbulence is the diffusion of energy. Vortexes in the turbulence may lead to energy exchange within the fluid flow, that is, mass points with higher energy pass kinetic energy to mass points with lower energy while mass points with lower energy also affect mass points with higher energy. As a result, such a diffusion effect enhances the transfer of kinetic energy.

When solid materials to be crushed are exposed to a high turbulence field, a gas-solid two-phase flow will be formed. The turbulence energy from the turbine is transferred gradually from larger vortexes to smaller vortexes by an inertia effect generated by a rotation at a high speed. As a result, materials are effectively crushed due to violent impact, self-grinding effect, shear effect generated due to the complicated turbulence.

The high turbulence mill achieves a breakthrough on the pulverizing mechanism, and possesses specific technical features such as bi-negative pressure, dual vortexes, high turbulence and high centrifugal force, and also possesses beneficial effects such as energy saving, capable of producing supermicro (sub-micrometer) powders and perfect environmental protection performance, thereby solving many shortcomings of currently used mechanical pulverizing method which have been addressed by industries and experts in the art for many years.

With the same power, an output of the high turbulence mill according to the present invention is 10 times that of current advanced jet mill, and energy consumption is only 10% of that of the latter. The pulverizing energy of the high turbulence mill doubles that of the jet mill, degree of pulverizing fineness exceeds sub-micrometer scale and its average granularity reaches a nano scale. Perfect technical effects are achieved in respect of both quality and quantity.

The high turbulence mill of the present invention offers a feasible way to realize a mass production of supermicro materials and nanomaterials.

The present invention will be described in detail referring to a preferred embodiment with reference to the accompanying drawings.

BRIEF DESCRIPTION OF DRAWINGS

FIG. 2 is a schematic view showing the structure of the bi-negative pressure turbine of the high turbulence mill according to present invention;

FIG. 3 is a sectional view of the bi-negative pressure turbine taken along the line A-A of FIG. 2;

FIG. 4 is a view of the arc-shaped blade mounted on the turbine shown in FIG. 2;

FIG. 5 is a sectional view of the arc-shaped blade taken along the line B-B of FIG. 4;

FIG. 6 is a partial view of the blade in FIG. 4, viewed in the direction indicated by C;

Reference numbers and corresponding items designated by the reference numbers are listed in detail as follows.

| | |
|---|---|
| hopper | 1 |
| circulating water tank | 2 |
| speed-adjustable electric motor | 3 |
| material feeding pipe | 4 |
| supporting frame | 5 |
| driving device | 6 |
| supporting frame | 7 |
| base | 8 |
| material discharging pipe | 9 |
| fixing bolt | 10 |
| spherical connector | 11 |
| inner flange plate | 12 |
| outer flange plate | 13 |
| spiral conveyer | 14 |
| blade | 15 |
| bi-negative pressure turbine | 16 |
| tooted ring-shaped guide stator | 18 |
| tooted impact plate | 20 |
| grinding casing | 21 |
| base plate | 29 |
| base circle of base plate | 291 |
| Screw holes | 151, 152 |
| base | 153 |
| rib portion | 154 |
| first inclined surface | 155 |
| second inclined surface | 156 |
| radial outer edge | 157 |
| radial inner edge | 158 |
| transverse outer edge | 159 |
| transverse inner edge | 160 |
| mounting portion | 210 |
| operating portion | 220 |
| mounting holes | 230, 240 |

DETAILED DESCRIPTION OF PREFERRED EMBODIMENTS

Figure 1B:
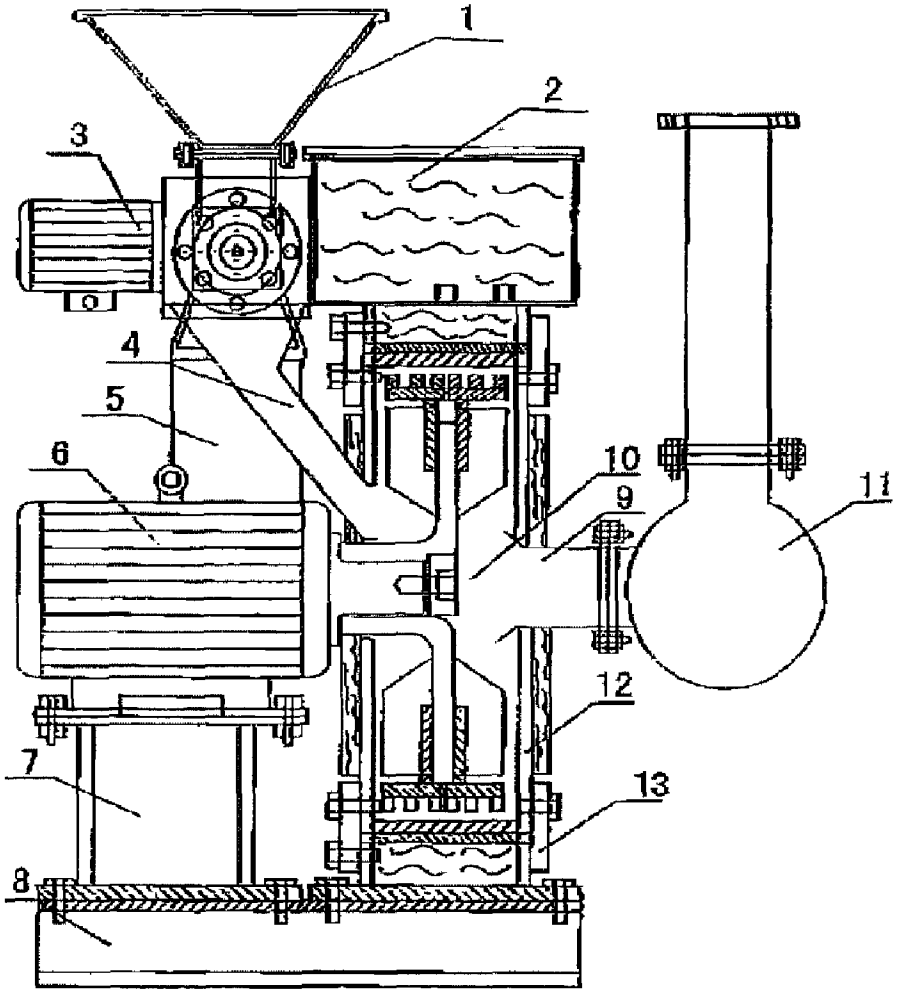
FIG. 1B is a side view of the high turbulence mill according to the present invention.
Figure 1A:
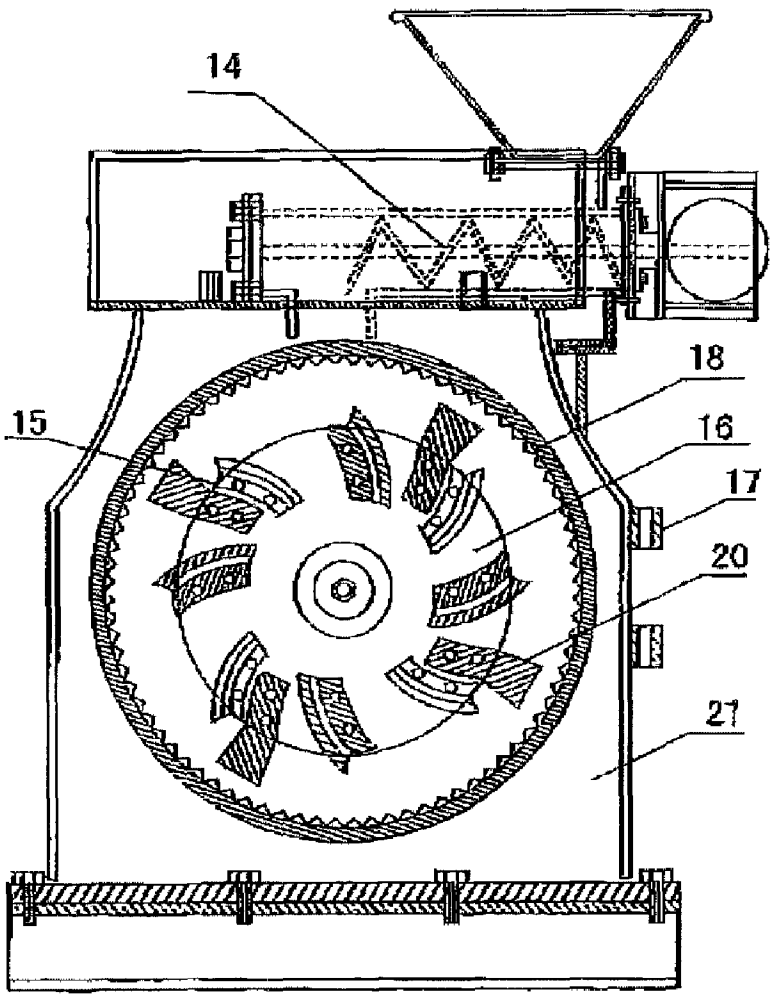
FIG. 1A is a front view of the high turbulence mill according to the present invention.

A high turbulence mill according to the present invention is shown in FIGS. 1A and 1B, which mainly includes a base 8, a grinding casing 21, a driving device 6, a spiral conveyer 14 and a control device and the like. The entire high turbulence mill is a horizontal one. The driving device 6 is mounted onto the base 8 via supporting frame 7, and comprises a motor and a driving shaft connected to an output shaft of the motor. In the embodiment of the present invention, the motor is preferably a variable frequency motor, and the driving shaft is connected to the variable frequency motor to drive a bi-negative pressure turbine 16 within the grinding casing 21.

The spiral conveyer 14 is secured onto the base 3 through a supporting frame 5, and positioned above the grinding casing 21. A hopper 1 is arranged over the spiral conveyer 14, for transferring the materials to be crushed into the spiral conveyer 14. The spiral conveyer 14 is driven by a speed adjustable motor 3.

A bi-negative pressure turbine 16 and a toothed ring-shaped guide stator 18 are provided within the grinding casing 21. The bi-negative pressure turbine 16 is connected to the driving shaft of the driving device 6, and may be rotated at a high speed in the grinding casing 21 by means of the driving shaft. The structure of the bi-negative pressure turbine 16 will be described in detail hereinafter. The toothed ring-shaped guide stator 18 is fixed to an inner circumference surface of the grinding casing 21.

A circulating water tank 2 is arranged above the grinding casing 21. The grinding casing 21 is divided into an inner chamber and an outer chamber wherein the outer chamber of the grinding casing 21 communicates with the circulating water tank 2. In this way, the operation temperature of the grinding casing 21 may be reduced by the water in the circulating water tank 2 so as to prevent the change in physical property of heat sensitive materials due to high grinding temperatures.

At each of left and right sides of the grinding casing 21, an inner flange plate 12 and an outer flange plate 13 are provided. A mounting hole is formed at a center of the left inner flange plate 12, through which the driving shaft of the driving device 6 is fixed to the bi-negative pressure turbine 16 located within the grinding casing 21 by a bolt 10. Further, a material inlet is formed on a region of the left inner flange plate 12 above the mounting hole. A material feeding pipe 4 connects the material inlet to the spiral conveyer 14. A material outlet is formed at a center portion of the right outer flange plate 13. A material discharging pipe 9 connects the material outlet to a spherical connector 11 provided at the outside of the grinding casing 21. The right outer flange plate 13 could be designed according to a desired size of output powders. In other words, as the material outlet becomes wider, powders with larger sizes and a correspondingly larger output volume would be achieved. In contrast, as the material outlet becomes narrower, powders with smaller sizes and a correspondingly smaller output volume would be achieved.

The spherical connector 11 is connected to a cyclone collector (not shown), and then the cyclone collector is connected to a cloth-bag collector (not shown), and next the cloth-bag collector is connected to an inducing fan (not shown), thereby collecting the finalized products. Since these equipments are known for those skilled in the art, a detailed description of them is omitted herein.

The control device is mainly composed of an electric control cabinet and a control panel, and is adapted to control the start-up, cessation of the high turbulence mill) as well as the rotation speed of the motor, according to different requirements.

As shown in FIG. 2, the bi-negative pressure turbine 16 according to the present invention comprises a base plate 29 and a plurality of blades 15 fitted on the base plate 29. The blades at either side of the base plate are uniformly arranged in a circumference direction of the base plate; and the blades at one side of the base plate alternate with those at opposite side of the base plate in the circumference direction of the base plate. In other words, the blades at one side do not coincide with the blades at the opposite side; and the blades at both sides are not symmetrical with respect to the base plate. Further, a plurality of toothed impact plates 20 is mounted on the base plate 29 to cooperate with the blades 15 and enhance grinding effect. The plurality of toothed impact plates 20 are respectively arranged at a position between two alternately arranged blades, and is symmetrical with respect to the base plate. The toothed impact plates 20 and the blades 15 are fixed to the base plate 29 respectively by a hexagon head bolt, a gasket, a flat washer and a nut, in a manner that all impact plates and blades have the same spiral orientations. As shown in FIG. 2, the toothed impact plates 20 and the blades 15 are alternately distributed on the left and right sides of the base plate 29, so as to achieve a dynamic balance of the bi-negative pressure turbine 16. In the present embodiment, eight groups of blades and toothed impact plates are provided. That is, at either side of the base plate 29, four groups of blades and four groups of toothed impact plates are provided.

As shown in FIGS. 4, 5 and 6, the blades 15 has a curved profile, and also has an L-shaped cross section. The blade 15 includes a base 153 and a rib portion 154 extending along a direction perpendicular to the base 153. Two holes 151 and 152 are perforated on the base 153 for bolts to pass through to hold the blades 15 onto the base plate 29. As shown in FIG. 5, a side end of the base 153 facing outwardly is formed with a first inclined surface 155, wherein the angle α formed between the first inclined surface 155 and a plane of the base plate 29 is in a range of 30°-60°, preferably 45°, A side of the blade 15 closer to the centre O of the base plate is formed with a second inclined surface 156. Particularly, the second inclined surface 156 is formed both on one end of the base 153 closer to the centre of the base plate, and one end of the rib portion 154 closer to the centre of the base plate. The angle β formed between the second inclined surface 156 and a plane of the base plate 29 is in a range of 45°-70°, preferably 60°, as shown in FIG. 6.

Furthermore, as shown in FIG. 4 and FIG. 2, in order to reduce abrasion of the blade, the blade is formed in a curved profile such that a radial outer edge 157 of the base 153 of the blade 15 coincides with the base circle 291 of the base plate 29, and radial inner edges 158 of all blades 15 are positioned on a circle concentric with the base circle 291; a transverse inner edge 160 and a transverse outer edge 159 of each blade 15 are two arcs with the same circle centre. In an embodiment, the same circle centre of the transverse inner edge 160 and the transverse outer edge 159 of the blade is a point at which a first arc and a second arc intersect, wherein the first arc has a radius as long as a radius of the base plate; and takes a first intersection point C at which the base circle 291 of the base plate 29 and a first line passing trough the centre O of the base plate 29 intersect, as its circle centre; and the second arc has a radius as long as the radius of the base plate; and takes a second intersection point B at which an arc 292 taking the centre O of the base plate as its centre and having a radius 0.25-0.35 times as long as the radius of the base plate and a second line passing through the centre O of the base plate and having a degree of 45° formed with the first line CO intersect, as its circle centre.

Figure 7:
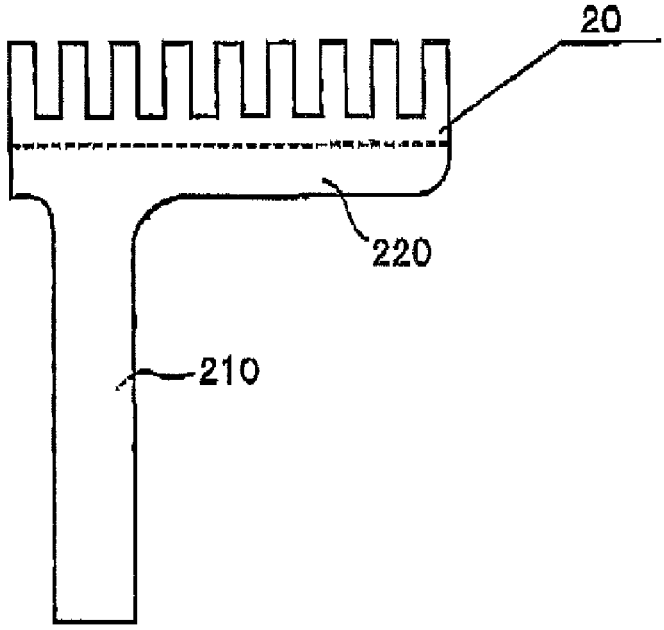
FIG. 7 is a view showing the toothed impact plate of FIG. 2.
Figure 8:
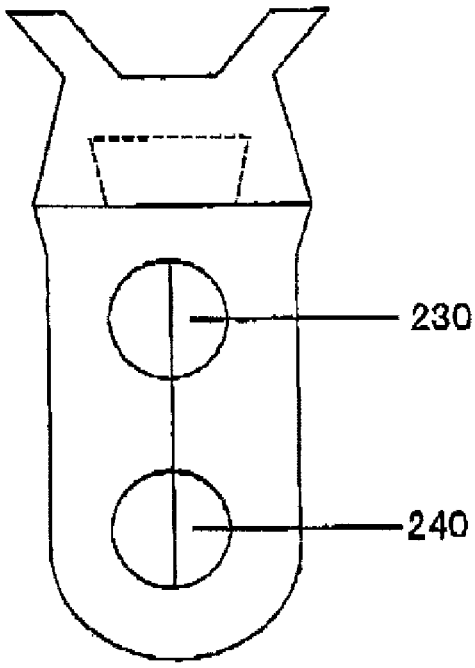
FIG. 8 is a side view of the toothed impact plate shown in FIG. 7.

As shown in FIGS. 7 and 8, the toothed impact plate 20 comprises a mounting portion 210 and an operating portion 220. The mounting portion 210 could have any suitable shape as long as the shape could assure the mounting portion to be fitted between the blades of the base plate. As shown in FIG. 2, the shape of the mounting portion 210 in a first embodiment is a distorted sector shape, so as to be in accordance with the profile of the blade. Also, as shown in FIGS. 7 and 8, the mounting portion has a rectangular profile with a rounded end. Two mounting holes 230 and 240 are formed on the mounting portion, for fixing the toothed impact plate 20 to the base plate 29 by bolts. The operating portion 220 is positioned above the mounting portion 210, which may be integrally formed with the mounting part 210, or may be a separated piece to be fixed onto the mounting part 210 by bolts. In the embodiment as shown in FIGS. 7 and 8, the operating portion 220 is formed with a swallow-tailed slot at the lower end thereof. A corresponding rail portion is formed on the mounting portion 210, which facilitates replacement of a worn operating portion. Rectangular impact teeth are formed on a top portion of the operating portion 220, and arranged in a circumference direction of the base plate 29. Meanwhile, as shown in FIG. 2, the side of each blade 15 having rib portion 154 is adjacent to corresponding toothed impact plate 20. That is, each toothed impact plate 20 is always arranged at one side of corresponding blade 15 having the rib portion 154.

Figure 9:
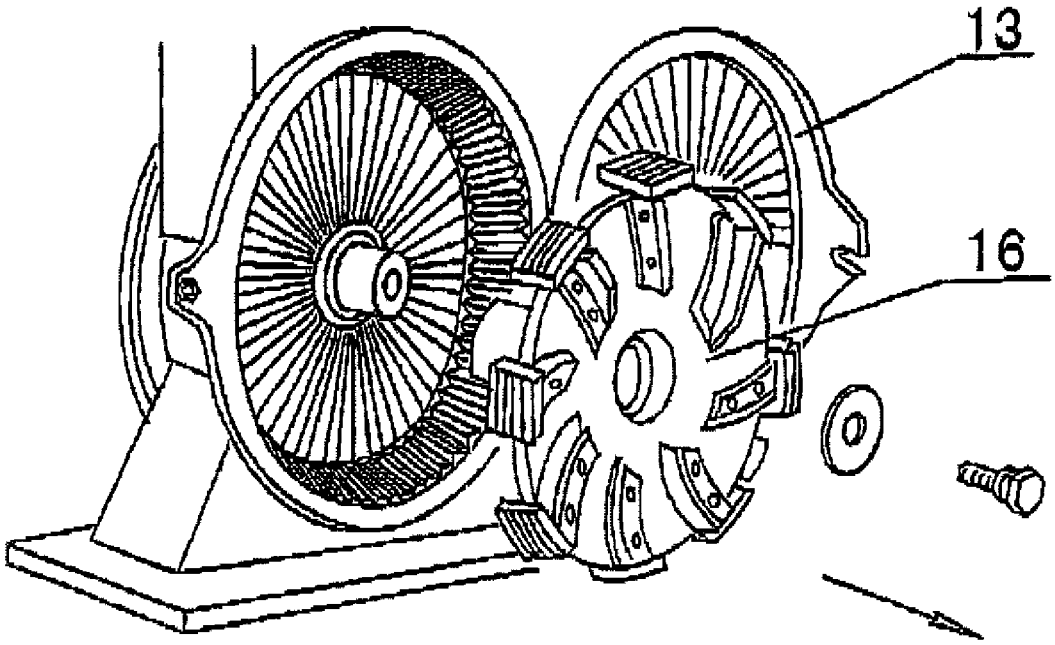
FIG. 9 is a perspective view showing the bi-negative pressure turbine of FIG. 1, during a disassembly process.

As shown in FIG. 9, a process of fitting an assembled bi-negative pressure turbine 16 into the grinding casing 21 includes the steps of mounting the bi-negative pressure turbine 16 onto the driving shaft extending into the grinding casing, and fixing them together by a bolt 10. As such, the bi-negative pressure turbine 16 will rotate in the grinding casing 21 under the driving force of the motor.

Figure 10:
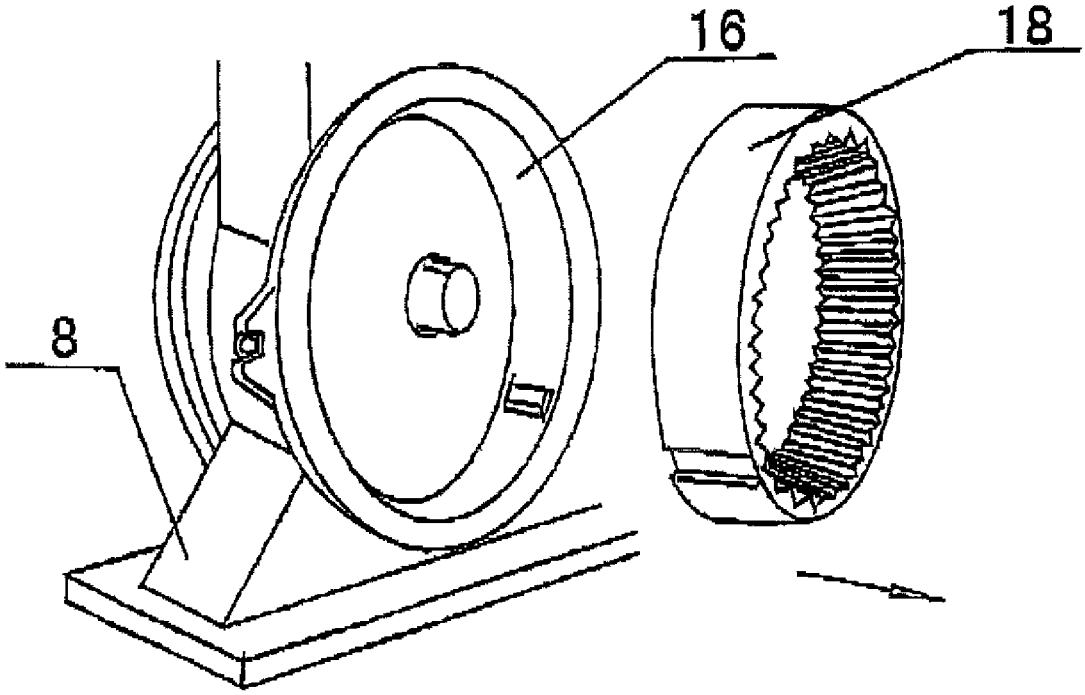
FIG. 10 is a perspective view showing the toothed ring-shaped guide stator of FIG. 1, during a disassembly process.

FIG. 10 shows a state that the toothed ring-shaped guide stator 18 of the present invention is detached from the inner circumference of the grinding casing 21. The toothed ring-shaped guide stator 18 has 50 or more serrate teeth, each of which has a tooth angle between 40°-50°. The toothed ring-shaped guide stator 18 is fitted onto the inner circumferential wall of the grinding casing 21 by means of an interference fit and/or key coupling.

An operating process of the high turbulence mill according to present invention will be described hereinafter.

The materials to be crushed are fed from the hopper 1 to the grinding casing 21 via the spiral conveyer 14 and the materials feeding pipe 4. The rotation of the bi-negative pressure turbine 16 driven by the variable frequency motor produces a negative-pressure turbulence air flow, by which the materials are crushed by an impact force produced by the high turbulence air flow as well as a high shear effect.

Since the curved blades 15 distributed at the left and fight sides and the swallow-tailed toothed impact plate 20 are assembled on the base plate of the bi-negative pressure turbine 16 and one end of each blade 15 adjacent to the shaft of the base plate is formed with an inclined surface, a double vortex will be generated when the turbine is rotated in a high speed, which then leads to a bi-negative pressure and therefore a strong centrifugal force. With the negative-pressure, the powder produced within the grinding casing 21 is not capable of leaking from the openings on flange plates positioned at the left and right sides of the grinding casing, thereby improving the sealing performance of the grinding casing. When solid materials to be crushed are exposed to the high turbulence field of the grinding casing 21, a gas-solid two-phase flow will be formed. Then the materials may receive turbulence energy from the turbine 16, which is transferred gradually from larger vortexes to smaller vortexes by an inertia effect. As a result, materials are effectively crushed due to violent impact, self-grinding effect, shear effect generated due to turbulence. Furthermore, a guidance shear force is produced by the toothed ring-shaped guide stator 18 in the grinding casing 21 and is applied to the materials. La the serrate tooth region, a violent self-grinding effect is generated among fine particles or the powders, accelerating an effective pulverization of the materials.

As increasingly finer powders decrease in their weights, they come to leave the centrifugal region and float in a region around the periphery of the centrifugal region, where they are sucked into the spherical connector 11 by means of the discharging pipe 9, and are collected by the cyclone collector and the cloth-bag collector.

The desired size of the finalized powder can be adjusted by adjusting the power of centrifugal fan and/or by adjusting the speed of the turbine.

INDUSTRIAL APPLICABILITY

The advantages and beneficial effects of present invention over the prior art will be described hereinafter.

1. A Considerable Energy-Saving Effect could be Achieved.

A traditional mechanical grinding equipment uses mechanical energy to directly drive a movement of the medium so as to grind materials, which results in a low grinding efficiency and high energy consumption. A jet mill utilizes the energy carried by air injected at a sound speed or a subsonic speed to crush materials. The conversion from mechanical energy to kinetic energy of air jet having a sound speed will require a higher energy, thereby in turn causing a larger energy consumption than the former.

The energy saving principle of the high turbulence mill according to present invention lies in that an inertia effect in turbulence tends to transfer energy to smaller vortex having large wavenumbers, and a viscosity effect will become stronger as the wavenumber increases and will consume the energy transferred from larger vortex by the inertia effect. Renault number Re of the present turbulence mill is $6.6\times10^5$. Since a high turbulence will occur when $Re>1.5\times10^5$, a high turbulence is ensured within the high turbulence mill according to the present invention. The higher the Renault number, the stronger the inertia effect, which could in turn transfer energy to regions having even larger wavenumbers. Accordingly, viscosity effect is exhibited. When the Renault number reaches a sufficiently high level, a dissipation region will only exist at regions having very large wavenumbers which are far away from high energy regions, and at this point the high energy regions do not take part in the viscosity effect and do not cause an energy dissipation.

The high turbulence mill of the present invention just utilizes such a property of turbulence having a high Renault number to economize energy for grinding. Since the Renault number ($Re=6.6\times10^5$) of the present turbulence mill has reached a sufficiently high level, the inertia effect possess a dominant position, which facilitates an effective grinding of the materials. In other words, the turbulence kinetic energy transferred from the mechanical equipment (i.e. the turbine) can be nearly completely transferred to materials to be crushed, thereby effectively grinding the materials and reducing the energy dissipation.

Such a feature of the high turbulence mill is unique compared with all presently used grinding equipments, which directly apply mechanical energy to the materials to be crushed and thus grind materials, thereby resulting in a very low grinding efficiency. For example, a ratio of an effective grinding work to entire output energy of a conventional ball mill is only 0.6%, and about 95-99% of energy is transformed into heat and is dissipated. Jet mill uses air jet at a sound or subsonic speed to grind materials, where a large amount of energy will be dissipated when mechanical energy is converted into kinetic energy carried by air jet, and therefore an even higher energy dissipation than the former one is generated.

The high turbulence mill of the present invention uses turbulence generated by electrically driven turbine to grind materials, and has a less useless energy-consumption. An investigation on energy consumption shows that for the same granularity and the same output, the energy consumption of the present invention is 5% of that of jet mill, 10% of that of mechanical impact mill, and 15% of that of vibrational mill. Therefore, the social and economic benefit brought by the energy saving effect of the present invention is great.

2. A Good Environmental Protection Effect could be Achieved

Nowadays, the prevention of environmental pollution and industrial noise pollution has raised a worldwide attention. Especially, the control of industrial dust is extremely difficult. Conventional grinding equipments have various shortcomings such as different degrees of powder leakage problem as well as a large volume of operation noise. In contrast, the high turbulence mill according to present invention could overcome said problems due to the specially designed turbine. When the turbine is rotated at a high speed, two negative pressures in the form of vortex are formed at both sides of the grinding casing due to the inclined surfaces of the blade, and then a strong turbulence is formed so as to effectively guarantee no leakage of the powder even if the shaft hole at the centre of the grinding casing is not provided with a sealing.

Furthermore, since identical numbers of blades and toothed impact plates are symmetrically and alternately fitted at both sides of the bi-negative pressure turbine, a perfect dynamic balance as well as a stable and reliable rotation of the turbine could be assured. In addition, since the turbine is directly driven by an electric motor, without any additional decelerating devices, the entire apparatus has a low level of noise, generally about 70 dB.

3. Possessing Special Technical Features and High Technical Content

Superfine powder producing technology is a new material processing technology emerged in the 1990s as a result of adapting the development of high technology, and currently only a few countries have mastered this technology. Currently used air jet grinding technology might grind materials into superfine powders of 10 μm (1200 mesh) to 2.5 μm (5000 mesh). However, this technology has the shortcomings of high energy dissipation, low production effectiveness and low process accuracy. With the fast development in modern science and technology, the requirement on technology for preparing powder materials becomes increasingly higher, and is directed to prepare micrometer-scale or nano-scale powders with high accuracy. Currently, there seems to be no report on mechanical preparation technique in which physical method is used to produce micrometer-scale or nano-scale powder materials.

The inventive high turbulence mill has the following special functions corresponding to the technique utilized:

(1) High Grinding Accuracy

A granularity of 0.1-0.9 μm could be obtained, and moreover the accuracy of powder is adjustable. Based on the grinding mechanism of the present invention, the technical effect that the granularity distribution is increasingly narrower and the size of powder becomes smaller with higher accuracy could be effectively achieved.

(2) Perfect Physical Property

The grinding principle is a pure physical activity which involves impacting and self-grinding of materials and does not involve any chemical reaction, and thus the original physical nature of the materials is effectively preserved.

(3) Perfect Performance at Low Temperature

The high turbulence mill is provided with cooling devices within the grinding casing, and the grinding of materials is rapidly conducted in a low temperature environment, so that alteration of physical property of heat sensitive material due to excessively high temperatures during the grinding process could be avoided.

(4) Grinding Function, Classification Function and Materials Modification Function are Combined Currently existing equipment for producing superfine powder must be equipped with additional classification equipment to produce supermicro powder meeting the requirement, and also must be equipped with additional materials modification equipment to produce active powder. Thus, the production technology is complicated, and the cost of the equipment is high. The high turbulence mill of the present invention combine three processes of grinding, classification and modification into one single process, and could simultaneously perform the processes of material grinding, powder classification and powder modification. The creative mechanism of the high turbulence mill is unique among currently used grinding equipments, which will greatly promote the progress of the grinder industry.

A preferred embodiment of the present invention has been disclosed, and the present invention is not limited to any detail of the preferred embodiment. Equivalent structural modifications can be made without departing from the spirit and scope of the invention defined in the appended claims. For example, more than eight or less than eight blades could be fitted onto the turbines and slightly changes to the shape or structure of the blades could be made.

The invention claimed is:

1. A high turbulence mill for producing supermicro powder, which comprises:

a driving device (6) provided on a base (8) and comprising a motor and a driving shaft coupled with the motor;

a hollow grinding casing (21) arranged above the base (8) and having a toothed ring-shaped guide stator (18) fixed to an inner circumference thereof;

a bi-negative pressure turbine (16) rotatably mounted within the grinding casing (21) and driven by the driving device (6), wherein the bi-negative pressure turbine comprises a base plate (29) and a plurality of blades (15) provided at both sides of the base plate (29) and having the same spiral orientation, wherein the blades at either side of the base plate are uniformly arranged in a circumference direction of the base plate; and the blades at one side of the base plate alternate with those at opposite side of the base plate in the circumference direction of the base plate;

a hopper (1) for delivering materials into the grinding casing (21) via a material feeding pipe (4);

a material discharging pipe (9) communicated with the grinding casing, for discharging pulverized products; and a control device for electrically controlling the high turbulence mill.

2. The high turbulence mill according to claim 1, wherein the grinding casing (21) is water-cooled and is divided into an inner chamber and an outer chamber, and the outer chamber is communicated with a circulating water tank (2).

3. The high turbulence mill according to claim 1 or 2, further including a spiral conveyer (14) driven by a speed-adjustable electric motor (3), one end of the spiral conveyer (14) is connected with the hopper (1) and the other end of the spiral conveyor (14) is connected with the material feeding pipe (4), for delivering materials into the grinding casing.

4. The high turbulence mill according to claim 1, wherein an end of the material discharging pipe (9) is connected with a spherical connector (11), a cyclone collector, a cloth-bag collector, and an inducing fan in series, for collecting the finalized products.

5. The high turbulence mill according to anyone of claims 1, wherein the grinding casing (21) is provided with two inner flange plates (12) and two outer flange plates (13), wherein one inner flange plate (12) and one outer flange plate (13) are positioned at the left side of the grinding casing (21) and the other inner flange plate (12) and the other outer flange plate (13) are positioned at the right side of the grinding casing (21);

a mounting hole is formed at a center portion of one of the inner flange plates (12) at one of the left side or right side, and the driving shaft of the driving device (6) goes through the mounting hole and is fixed to the bi-negative pressure turbine (16) located within the grinding casing (21) by a bolt (10);

a material inlet is formed on a region of said one inner flange plate (12) over the mounting hole, and the material feeding pipe (4) is connected to the material inlet; and a material outlet is formed at a center portion of the inner flange plate at the opposite side, and the material discharge pipe (9) is connected to the material outlet.

6. The high turbulence mill according to claim 1, wherein the toothed ring-shaped guide stator (18) has 50 or more serrate teeth, each of which has a tooth angle between 40°-50°.

7. The high turbulence mill according to claim 1, wherein each blade (15), having a curved profile with an L-shaped cross section, is composed of a base (153) and a rib portion (154) extending from the base in a direction perpendicular to the base, with two screw holes (151, 152) perforated at an inner side portion of the base through which bolts are inserted to fix the blade (15) onto the base plate (29).

8. The high turbulence mill according to claim 7, wherein the base of the blade is formed with a first inclined surface (155) at an outer side end thereof, and an angle $\alpha$ formed between the first inclined surface and a plane of the base plate (29) is in a range of 30°-60°.

9. The high turbulence mill according to claim 7, wherein the blade (15) is further formed with a second inclined surface (156) at a side end thereof closer to a centre of the base plate (29), and an angle $\beta$ formed between the second inclined surface (156) and the plane of base plate (29) is in a range of 45°-70°.

10. The high turbulence mill according to claim 8 or 9, wherein the curved profiles of the blades are formed in such a manner that radial outer edges (157) of bases (153) of the blades (15) coincide with a base circle (291) of the base plate (29), radial inner edges (158) of the blades (15) are positioned on a circle concentric with the base circle (291), and a transverse inner edge (160) and a transverse outer edge (159) of each blade are two arcs with the same circle centre.

11. The high turbulence mill according to claim 10, wherein the same circle centre of the transverse inner edge and the transverse outer edge of the blade is a point at which a first arc and a second arc intersect;

wherein the first arc has a radius as long as a radius of the base plate; and takes a first intersection point (C) at which the base circle (291) of the base plate (29) and a first line (OC) passing through the centre (O) of the base plate (29) intersect, as its circle centre; and the second arc has a radius as long as the radius of the base plate; and takes a second intersection point (B) at which an arc (292) taking the centre (O) of the base plate as its centre and having a radius 0.25-0.35 times as long as the radius of the base plate and a second line passing through the centre (O) of the base plate and having a degree of 45° formed with the first line (OC) intersect, as its circle centre.

12. The high turbulence mill according to claim 1, further comprising a plurality of toothed impact plates (20) arranged in pairs between two adjacent blades (15) at both sides of the base plate (29).

13. The high turbulence mill according to claim 12, wherein the toothed impact plate (20) comprises:

a mounting portion (210) formed with two mounting holes (230, 240) through which bolts are inserted to fix the toothed impact plate (20) onto the base plate (29); and an operating portion (220) located above the mounting portion (210), which is integrated with the mounting portion (210) via a swallow-tailed slot thereof and is formed on its top with rectangular teeth extending in a circumference direction of the base plate (29).

* * * * *